US005826711A

United States Patent [19]

Ovadia

[11] Patent Number: 5,826,711

[45] Date of Patent: Oct. 27, 1998

[54] JEWELRY DISPLAY AND STORAGE TRAY

[76] Inventor: Joseph Ovadia, 109 Longhill Rd., Little Falls, N.J. 07424

[21] Appl. No.: 864,193

[22] Filed: May 28, 1997

[51] Int. Cl.[6] ..... B65D 85/02

[52] U.S. Cl. ..... 206/6.1; 206/566

[58] Field of Search ..... 206/6.1, 562, 563, 206/564, 566

[56] References Cited

U.S. PATENT DOCUMENTS

| | | | |
|---|---|---|---|
| D. 303,764 | 10/1989 | Kilmartin, III | D9/423 |
| D. 349,204 | 8/1994 | Lefebvre | D6/476 |
| 862,729 | 8/1907 | Goldsmith | 206/564 |
| 1,456,613 | 5/1923 | Bartels | 206/566 |
| 1,475,319 | 11/1923 | Rueckert | 206/566 |
| 2,000,681 | 5/1935 | Weller | 206/6.1 |
| 2,788,123 | 4/1957 | Levis et al. | 206/566 |
| 4,282,975 | 8/1981 | Ovadia | 206/566 |
| 4,432,456 | 2/1984 | Ovadia et al. | 206/566 |
| 4,917,235 | 4/1990 | Feiler | 206/566 |
| 4,948,204 | 8/1990 | Kilmartin. III | 312/140 |
| 4,993,545 | 2/1991 | Feiler | 206/566 |
| 5,505,294 | 4/1996 | Kilmartin. III | 206/6.1 |
| 5,511,653 | 4/1996 | Ovadia | 206/6.1 |

*Primary Examiner*—Jimmy G. Foster
*Attorney, Agent, or Firm*—Sofer & Haroun, LLP

[57] ABSTRACT

A jewelry display and storage tray for stacking upon like trays includes a tray member having an upper face and a lower face. The upper face of the tray member having a plurality of recesses extending downward from the upper face for accommodating items of jewelry, such as rings, when the tray member is oriented in a substantially horizontal position. The tray member is provided with a sunken channel surrounding the recesses on the upper face for receiving a middle layer therein which is provided with a plurality of slits corresponding with the recesses in the tray member and which facilitates retention of items of jewelry positioned within the recesses. A upper pad having a plurality of openings corresponding to the recesses in the tray member is disposed upon the upper face of the tray member for providing access to the recesses in the tray member and for retaining the middle layer within the sunken channel on the upper face of the tray member.

20 Claims, 4 Drawing Sheets

JEWELRY DISPLAY AND STORAGE TRAY

FIELD OF THE INVENTION

This invention relates generally to devices for displaying and storing items of jewelry, and more particularly, to a unitarily molded display and storage apparatus which can be used in typical fashion for display purposes and which can be compactly stacked with similar devices for easy storage and transport.

BACKGROUND OF THE INVENTION

Jewelry articles, particularly rings, can be stored and displayed in a variety of trays, holders or racks. The prior art is replete with numerous types of jewelry displays for rings, one of which is generally described in U.S. Pat. No. 4,282,975, and which comprises a tray having an upper member provided with a plurality of downward extending recesses and a lower member having a plurality of upward recesses, the upper and lower members being fitted together so that the downwardly extending recesses are positioned in spaces located between the upwardly extending recesses. The downwardly extending recesses in the upper member are configured for receiving rings inserted therein. The upwardly extending recesses on the lower surface are configured such that when the tray is stacked upon another tray, the rings in the lower tray exist within the upwardly extending recesses. The tray also includes a pad, generally of a plush felt or velvet material, placed upon the upper face of unitary member in the tray. The felt pad which rests within the tray is provided with a plurality of downwardly extending recesses through which the rings inserted into the downward extending recesses pass such that the circular shank or lower portion of the ring is retained in the felt. The tray portion of this type of display is often configured to permit a plurality of trays to be nested upon each in stacked fashion.

In addition to the upper and lower members, the prior art tray is comprised of additional layers thus providing a tray which is extremely thick and which has a height which takes up a great deal of space when a plurality of trays are placed on a surface on display and when stacked upon each other for storage or transport. The height of the tray thus prevents the use of additional trays for the display of more jewelry because of the limit in storage space when the trays are stacked upon each other.

Accordingly, there is a need for a jewelry display and storage apparatus for accommodating numerous items of jewelry and which is thin in height so as to permit the display of additional articles of jewelry and to facilitate storage and transport of the jewelry.

OBJECTS AND SUMMARY OF THE INVENTION

It is thus a general object of the present invention to provide a jewelry display apparatus in the form of a tray which can be used for both display purposes as well as storage purposes.

A more specific object of the present invention is to provide a jewelry display and storage apparatus unitarily molded from a lightweight plastic material and which has a tray member provided with a plurality of recesses dispersed about the surface for displaying and retaining jewelry items, such as ring, therein.

It is another object of the present invention to provide a jewelry display and storage apparatus configured to permit easy stackability of multiple jewelry display and storage apparatuses upon one another for storage and transport.

It is a further object of the present invention to provide a jewelry display and storage apparatus in which rings arranged on the apparatus are securely retained therein.

It is still an additional object of the present invention to provide a jewelry display and storage apparatus having support layers disposed upon the unitary surface and provided with slits dispersed thereon and corresponding with the recesses in the unitary surface of the apparatus for retaining rings arranged therein.

These and other objects of the invention are realized by providing a jewelry display and storage apparatus in the form of a tray comprised of a tray member having an upper face and a lower face. Dispersed about the tray member are a plurality of recesses which extend from the upper face in a downward direction for receiving articles of jewelry such as rings, when a major plane of the tray member is oriented in a substantially horizontal position. The region surrounding each of the recesses on the upper face of the tray member includes a sunken channel for receiving a middle layer which is configured to be removably received within the receptacle such that the middle layer lies substantially flush with the upper face of the tray member when positioned in the sunken channel thereon. The middle layer is provided with a one or more slits therethrough which correspond to the recesses in the tray member when the middle layer is positioned in the channel. Additionally, when positioned in the channel of the tray member, the slits in the middle layer extend across the recess such that rings inserted into the recess are retained therein by the slits. The presence of the sunken channel in the tray member within which the middle layer is disposed, creates a tray which is significantly thinner than prior art trays. An upper face pad is also provided which is disposed upon the upper face of the tray member and overlays the middle layer to retain the middle layer within the sunken channel in the tray member and also to provide a pleasing aesthetic display appearance to the tray. The upper face pad is provided with a plurality of openings which correspond to the recesses in the tray member and the slits in the middle layer through which rings are inserted in the apparatus.

The recesses in the tray member, along with the slits in the middle layer and the openings in the upper face pad are advantageously arranged in offset or staggered rows such that subsequent trays may be easily nestled upon one another by rotating each subsequent tray 180 relative to the previous tray and placing the subsequent tray upon the previous tray. In this configuration, the trays are easily fitted together so that rings arranged within the recesses of a first or lower tray are positioned between the downward extending recesses of the second tray stacked upon the first. As such, the slender configuration of the trays afforded by placing the middle layer within the sunken channel on the upper face of the tray member, affords a greater number of trays which can be easily stacked for storage and/or transport. Accordingly, the ability to stack more trays for storage and transports affords the jeweler the opportunity to place more trays containing jewelry on display.

The jewelry display and storage tray of the present invention is of simple construction and easy to manufacture. The tray member may be injection or vacuum molded from a lightweight plastic material or from a number of other materials such as wood, metal, lucite or styrene. The middle layer is advantageously a die-cut piece of foam configured to fit within the sunken channel in the upper face of the tray member and having slits therethrough which correspond to the recesses in the tray member. Upper face pad is advantageously a die-cut piece of foam or other material configured for positioning upon the upper face of the tray member and including openings which correspond with the slits in the middle layer and the recesses in the tray member.

The above description sets forth rather broadly the more important features of the present invention in order that the detailed description thereof that follows may be understood, and in order that the present contributions to the art may be better appreciated. Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

DETAILED DESCRIPTION OF THE DRAWINGS

In the drawings in which like reference characters denote similar elements throughout the several views.

DETAILED DESCRIPTION OF THE PRESENTLY PREFERRED EMBODIMENT

Figure 1:
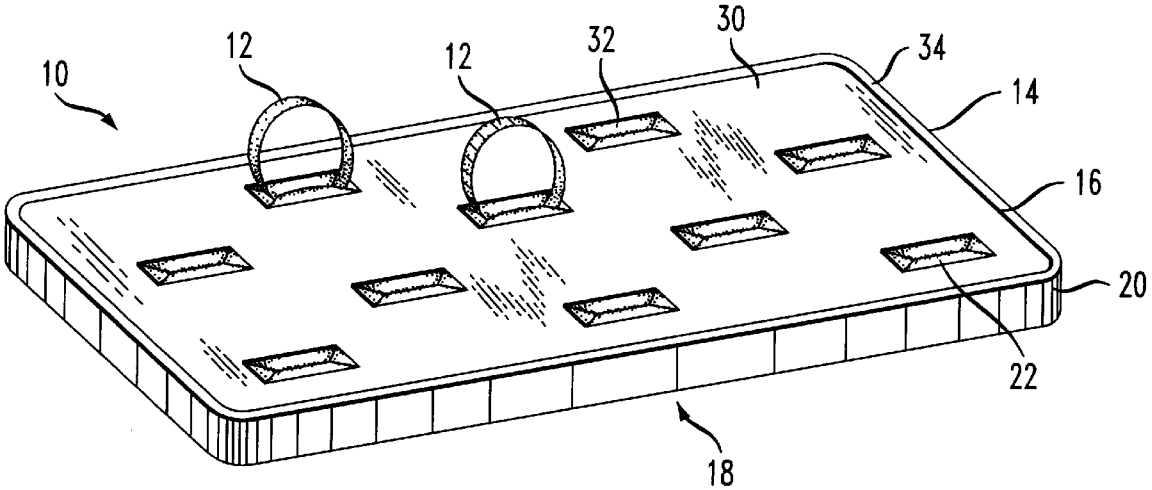
FIG. 1 illustrates a perspective view of the jewelry display and storage tray according to one embodiment of the present invention.
Figure 2:
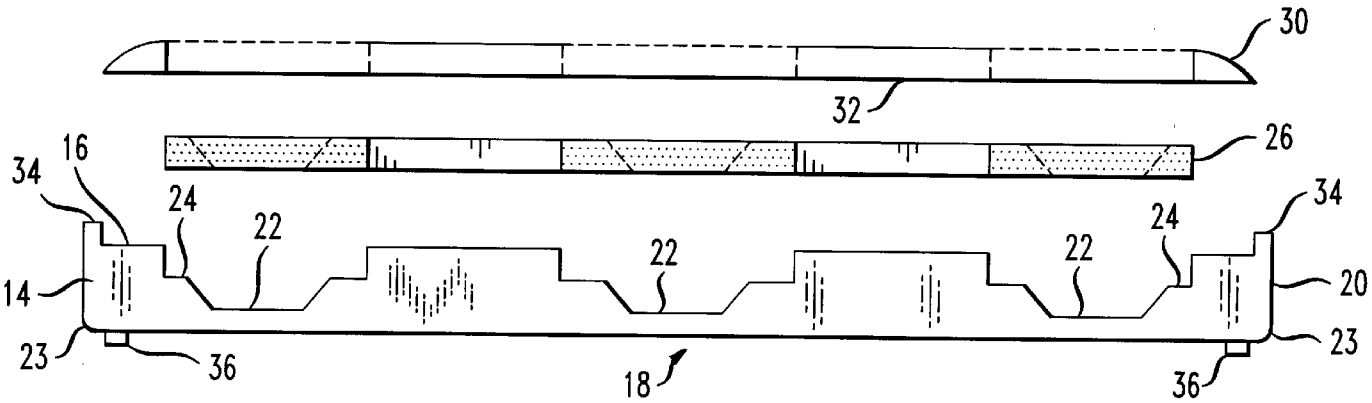
FIG. 2 illustrates an exploded elevational cross-section of the jewelry display and storage tray according to one embodiment of the present invention viewed along line A—A of FIG. 3.
Figure 3:
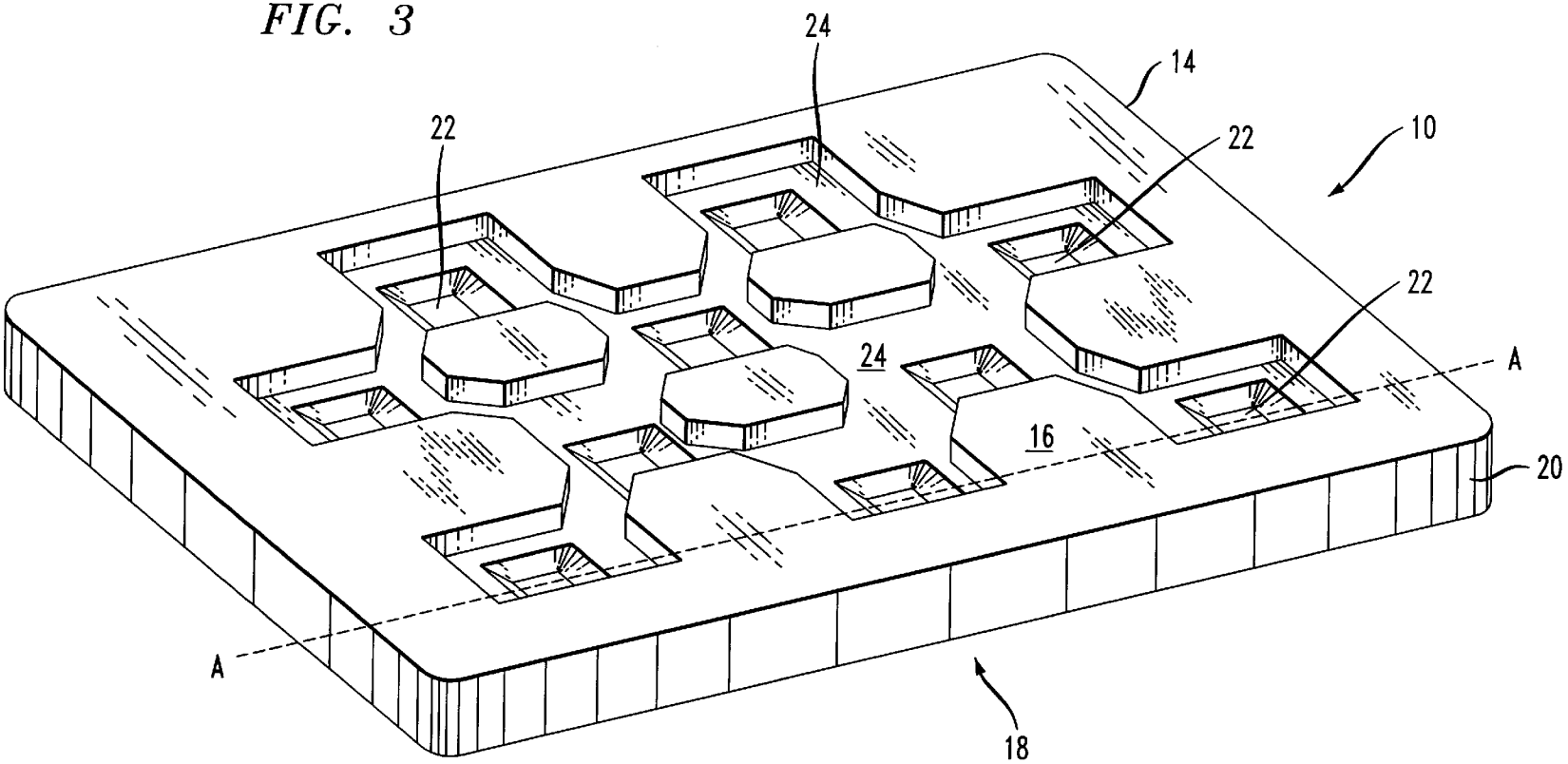
FIG. 3 illustrates a top view of the tray member of the jewelry display and storage tray according to one embodiment of the present invention.

With initial reference to FIGS. 1–3, the jewelry display and storage tray 10 of the present invention is shown in its preferred embodiment for retaining articles of jewelry such as rings 12. Tray 10 is preferably comprised of a unitary tray member 14 having an upper face 16 and a lower face 18, and which may be injection or vacuum molded from a lightweight plastic material, although the invention is not limited in this respect and other materials such as wood, lucite, styrene and metal may be used to form tray member 14. Tray 10 is provided with a continuous sidewall 20 substantially perpendicular to tray member 14 and extending about the entire periphery of tray member 14. Continuous sidewall 20 is further provided with an upstanding lip 34 which extends above upper surface 16 of tray member 14, and a lower portion 23 extending downward from tray member 14 as illustrated in FIGS. 1,2,6 and 7. Lower portion 23 of sidewall 20 is advantageously provided with a plurality of feet 36 configured to be received within upper lip 34 of a second tray, indicated as 10*b* in FIG. 7, stacked upon a first tray, indicated as 10*a* in FIG. 7, and for facilitating the stacking of numerous additional trays 10 upon each other such that each of the trays are securely nested upon one another for storage and/or transport. Additionally, continuous sidewall 20 may be covered with velvet or other material so as to give tray 10 an attractive appearance for displaying items of jewelry in a showcase or display window.

Figure 4:
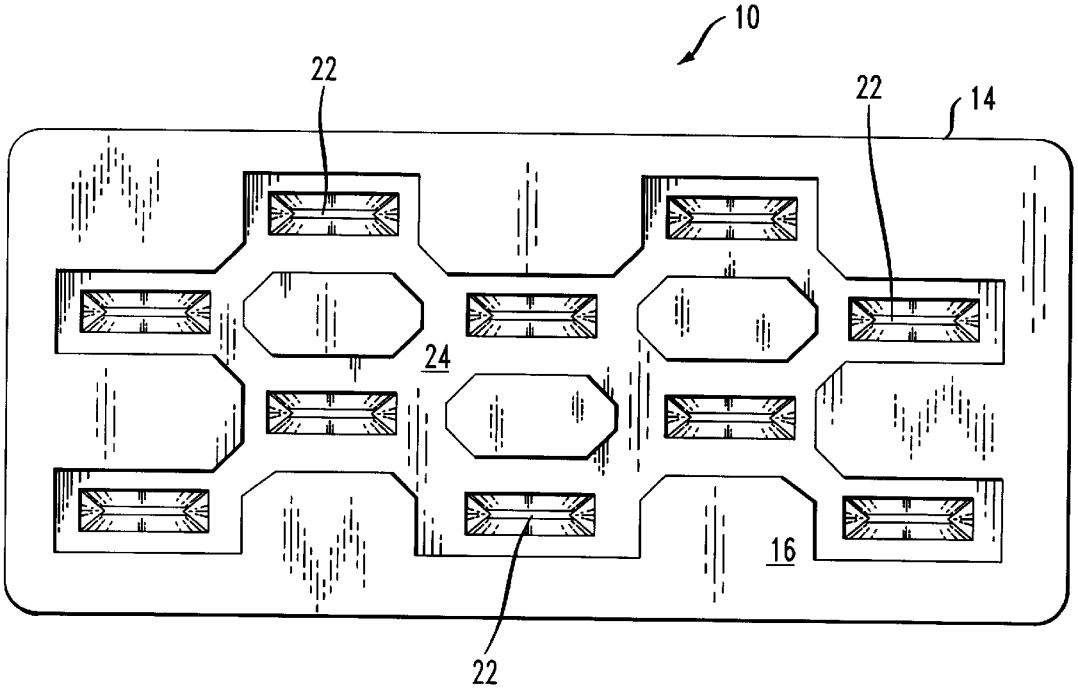
FIG. 4 illustrates a top view of the tray member of the jewelry display and storage tray according to one embodiment of the present invention.
Figure 5:
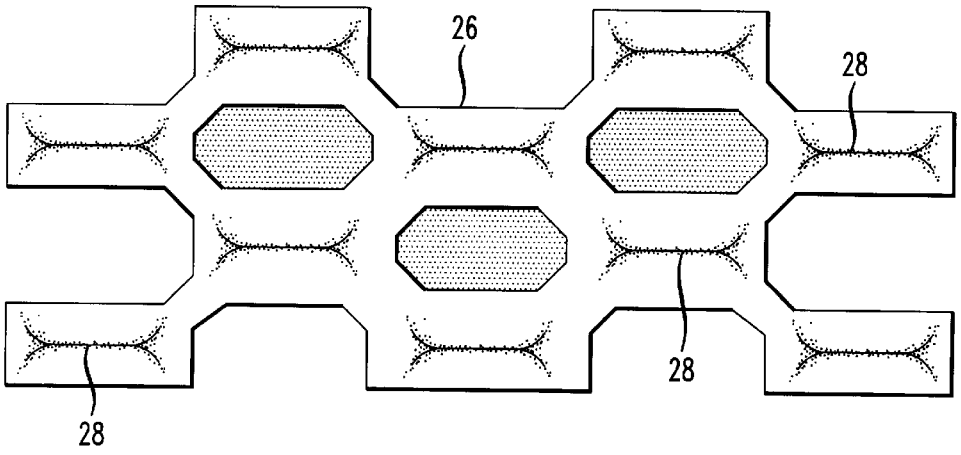
FIG. 5 illustrates a top view of a middle layer for placement upon the tray member according to one embodiment of the present invention.
Figure 6:
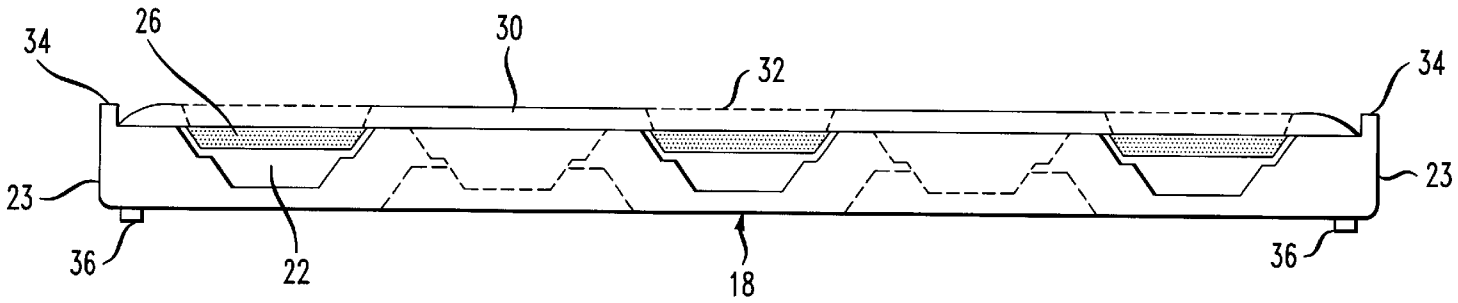
FIG. 6 illustrates a cross-sectional view of the jewelry display and storage tray.
Figure 7:
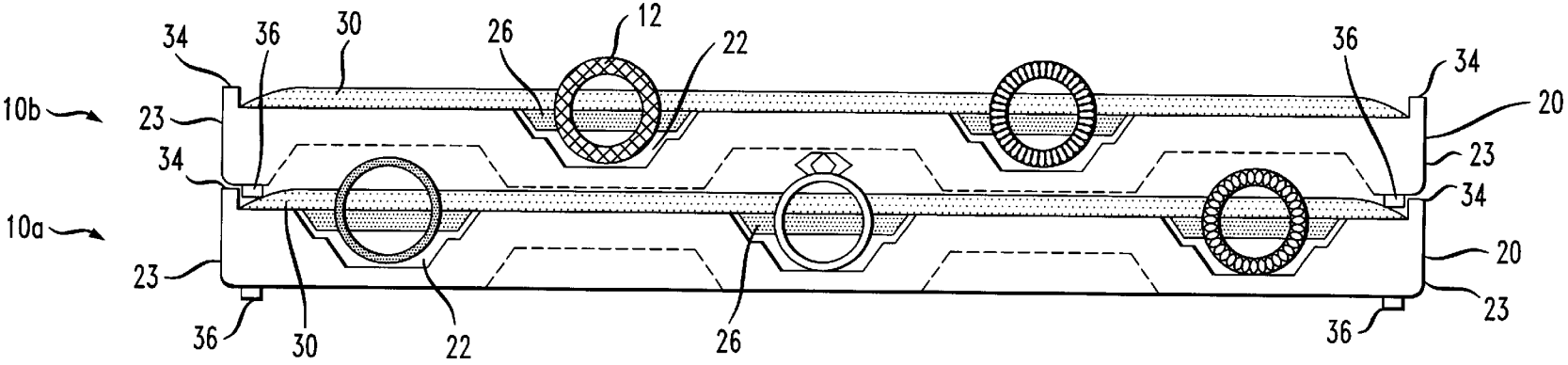
FIG. 7 illustrates a side cross-sectional view of two jewelry display and storage trays having rings accommodated therein according to one embodiment of the present invention, and shown in a stacked condition for storage and transport.

With reference to FIGS. 1–4, tray member 14 is provided with a plurality of recesses 22 dispersed upon upper face 16 and extending downwardly for accommodating and retaining articles of jewelry, such as rings 12, therein as shown in FIGS. 1 and 7. As illustrated in FIGS. 2–4, upper face 16 of tray member 14 is further provided with a sunken channel 24 which surround recesses 22 dispersed thereon. Sunken channel 24 is configured to receive a middle layer 26 (shown in FIG. 5) which is positioned within channel 24 and which is provided with a plurality of slits 28, as illustrated in FIG. 5, which correspond to recesses 22 when middle layer is 26 positioned in sunken channel 24. Middle layer 26 is normally in the range of about ⅛ to ¼ inch thick, with sunken channel 24 constructed to be a corresponding ⅛ to ¼ inch in depth. By positioning middle layer 26 in sunken channel 24, middle layer 26 lies substantially flush with upper surface 16 of tray member 14 such that the positioning of middle layer 26 on tray member 14 does not add or adds only minimal additional height to tray 10. By keeping the height of tray member 14 to a minimum, more trays 10 may be stacked upon one another as illustrated in FIG. 7 such that storage and transport are facilitated. Middle layer 26 is advantageously configured to form fit within sunken channel 24. Although an adhesive such as tape or glue may be used to secure middle layer 26 within sunken channel 24 it is to be understood that such glue or tape is not necessary as upper face pad 30 is provided with a pressure sensitive adhesive so that the upper face pad 30 is secured to both the middle lay 26 and to the upper face 16 of tray member 14. It is to be also understood that although middle layer 26 is illustrated in FIG. 5 as a die-cut single piece, the invention is not limited in this respect and middle layer 26 can be made up of any number of pieces configured to be positioned in sunken channel 24.

With continued reference to FIGS. 1 and 2, an upper face pad 30 is positioned upon upper face 16 of tray member 14 and overlays middle layer 26. Upper face pad 30 is provided with a plurality of openings 32 which correspond with slits 28 of middle layer 26 and recesses 22 in tray member 14. As such, articles of jewelry, such as rings 12, are inserted through openings 32 in upper face pad 30, through slits 28 in middle layer 28 and into recesses 22 of tray member 14. Slits 28 of middle layer 26 are configured so as to provide support and to add additional retaining properties when ring 12 is inserted therethrough as illustrated in FIG. 1 Upper face pad 30 and middle layer 26 are advantageously the same color or material, such as leather, velvet or felt, so as to provide an aesthetically appealing display when rings 12 or other items of jewelry are retained therein and displayed. Additionally, upper face pad 30 may be provided with an adhesive such as a pressure sensitive adhesive on its lower surface 32, as illustrated in FIG. 2 for retaining upper face pad 30 and middle layer 26 to upper face 16 of tray member 14 when upper face pad 30 is positioned thereon.

With reference to stacking numerous trays upon one another for storage and/or transport, recesses 22 dispersed on tray member 14 of tray 10 are advantageously arranged in offsetting or staggered rows such that by rotating a subsequent or upper tray (indicated as 10*b* in FIG. 7 stacked upon a lower tray (indicated as 10*a* in FIG. 7 by 180, the multiple trays (indicated as upper tray 10*b* and lower tray 10*a* in FIG. 7 are complementarily fit together such that the downwardly extending recesses 22 of each subsequently stacked upper tray 10*b* are located between rings 12 arranged in openings 32 of upper face pad and extending within recesses 22 of the lower tray 10*a* as illustrated in FIG. 7. An interlocking structure is thus formed which securely retains rings 12 within each tray 10 and which are configured to conserve space by providing a slender tray 10 which facilitates storage and/or transport of numerous trays 10. In accordance with the invention, it apparent that the downwardly extending recesses 22 of a first tray which is stacked upon a second tray be located between openings 32 of upper face pad 30 and hence the downwardly extending recesses of the second tray. Since recesses 22 are arranged in staggered or offsetting rows, it is also apparent that stacked trays have their arrangement of rows rotated 180 with respect to each other. With the trays filed with items of jewelry such as rings, it will be obvious to anyone stacking the trays to rotate adjacent trays until nesting is accomplished.

It is to be appreciated that although the present invention has been described herein with reference to retaining, displaying and storing rings, tray 10 of the present invention may be configured to work equally well with other articles of jewelry such as bracelets, earrings, anklets, and watches. It is also understood that although recesses 22 have been illustrated as rectangular in shape, the invention is not limited in this respect and recesses 22 may be configured in any shape to accommodate and retain items of jewelry therein. It is also understood that openings 32 in upper face pad 30 are not limited to the rectangular shape is illustrated in the drawing figures. Furthermore, continuous sidewall 20 may be draped with a material or painted a color to provide for a more aesthetically appealing tray for display.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

It is to be understood that the drawings are not necessarily drawn to scale, but that they are merely conceptual in nature.

What is claimed is:

1. A jewelry display and storage tray, comprising:

a tray member having an upper face and a lower face, said tray member having a plurality of recesses extending from said upper surface in a downward direction for accommodating items of jewelry when said tray member is oriented in a substantially horizontal direction, said upper face further including a sunken channel extending around at least one of said recesses to a position below said upper face;

a middle layer configured to be received within said channel so that said middle layer lies substantially within said sunken channel flush with said upper face of said tray member, said layer having a plurality of slits therethrough, said slits corresponding to said recesses in said tray member to provide access to said recesses for receiving said items of jewelry; and an upper face pad overlaying said upper face of said tray member, said upper face pad including a plurality of openings, each of said openings corresponding with one of said downwardly extending recesses of said tray member to provide access to said recesses for receiving said items of jewelry.

2. The jewelry display tray according to claim 1, wherein said sunken channel is in the range of about ⅛–¼ inch in depth.

3. The jewelry display tray according to claim 1, wherein said middle layer is die-cut and formed of a one piece construction.

4. The jewelry display tray according to claim 1, wherein said middle layer positioned within said sunken channel lies substantially flush with said upper face of said tray member.

5. The jewelry display tray according to claim 1, wherein said tray member further comprises a continuous sidewall extending about the entire periphery of said tray member.

6. The jewelry display tray according to claim 5, wherein said continuous sidewall extends upward to define an upstanding lip, said continuous sidewall also extending downward from said tray member to define a lower portion.

7. The jewelry display tray according to claim 6, wherein said lower portion further comprises a plurality of feet, wherein said feet of a first tray are configured to be received upon said upstanding lip of a second tray positioned below said first tray when said first tray is stacked upon said second tray.

8. The jewelry display tray according to claim 1, wherein said downwardly extending recesses in said tray member are arranged in a plurality of rows, said rows being offset such that adjacent rows have different numbers of downwardly extending recesses, the recesses of one row being substantially between the recesses of an adjacent row.

9. The jewelry display tray according to claim 8, wherein said downwardly extending recesses are arranged such that a second tray may be complementarily nestled upon a first tray by rotating said second tray 180 degrees wherein said items of jewelry positioned in said recesses of said first tray are secured between said downwardly extending recesses of said second tray.

10. The jewelry display tray according to claim 1, wherein said upper face pad comprises a plurality of substantially rectangular shaped openings for providing access to said downwardly extending recesses in said tray member.

11. The jewelry display tray according to claim 1, wherein said upper face pad is secured to said upper face of said tray member with an adhesive.

12. The display tray according to claim 11, wherein said adhesive on said upper face pad secures said upper face pad to said upper face of said tray member and also secures said upper face pad to said middle layer.

13. A jewelry display and storage tray configured to be stacked upon like trays, comprising:

a tray member having an upper face and a lower face, said tray member having a plurality of recesses extending from said upper surface in a downward direction for accommodating items of jewelry when said tray member is oriented in a substantially horizontal direction, said tray member having a continuous sidewall extending about the periphery of said tray member, said upper face further including a sunken channel extending around at least one of said recesses to a position below said upper face;

a middle layer configured to be received within said channel so that said middle layer is positioned within said sunken channel such that said middle layer lies substantially flush with said upper face of said tray member, said layer having a plurality of slits therethrough, said slits corresponding to said recesses in said tray member to provide access to said recesses for receiving said items of jewelry; and an upper face pad overlaying said upper face of said tray member, said upper face pad including a plurality of openings, each of said openings corresponding with one of said downwardly extending recesses of said tray member to provide access to said recesses for receiving said items of jewelry.

14. The jewelry display tray according to claim 13, wherein said continuous sidewall extends upward from said tray member to define an upstanding lip, said continuous sidewall also extending downward from said tray member to define a lower portion.

15. The jewelry display tray according to claim 14, wherein said lower portion further comprises a plurality of feet, wherein said feet of a first tray are configured to be received upon said upstanding lip of a second tray positioned below said first tray when said first tray is stacked upon said second tray.

16. The jewelry display tray according to claim 13, wherein said middle layer includes a top side and a bottom side, said bottom side having an adhesive dispersed thereon for securing said pad in said sunken channel in said upper face of said tray member.

17. The jewelry display tray according to claim 13, wherein said downwardly extending recesses in said tray member are arranged in a plurality of rows, said rows being offset such that adjacent rows have different numbers of downwardly extending recesses, the recesses of one row being substantially between the recesses of an adjacent row.

18. The jewelry display tray according to claim 17, wherein said downwardly extending recesses are arranged such that a second tray may be complementarily nestled upon a first tray by rotating said second tray 180 wherein said items of jewelry positioned in said recesses of said first tray are secured between said downwardly extending recesses of said second tray.

19. The display tray according to claim 13, wherein said upper face pad is secured to said upper face of said tray member with an adhesive.

20. The display tray according to claim 19, wherein said adhesive on said upper face pad secures said upper face pad to said upper face of said tray member and also secures said upper face pad to said middle layer.

* * * * *